United States Patent [19]

Caron

[11] 3,982,497

[45] Sept. 28, 1976

[54] JET-PROPELLED POWER BOAT

[76] Inventor: Charles A. Caron, 444 Bedford St., Stamford, Conn. 06904

[22] Filed: Oct. 3, 1975

[21] Appl. No.: 619,502

Related U.S. Application Data

[63] Continuation-in-part of Ser. No. 507,073, Sept. 18, 1974, abandoned.

[52] U.S. Cl. ..... 115/70; 9/6 P; 115/.5 E

[51] Int. Cl.[2] ..... B63B 5/24

[58] Field of Search ..... 115/12 R, 70, 6.1, .5 E; 9/6 P

[56] References Cited

UNITED STATES PATENTS

| | | | |
|---|---|---|---|
| 2,708,759 | 5/1955 | Strawn | 115/.5 X |
| 3,543,314 | 12/1970 | Tropf et al. | 114/66.5 R |
| 3,608,512 | 9/1971 | Thompson | 115/70 |
| 3,623,447 | 11/1971 | Jacobson | 115/12 R |
| 3,718,111 | 2/1973 | DelVecchio | 115/70 |

FOREIGN PATENTS OR APPLICATIONS

| | | | |
|---|---|---|---|
| 710,083 | 6/1954 | United Kingdom | 115/17 |

*Primary Examiner*—Duane A. Reger
*Assistant Examiner*—Gregory W. O'Connor
*Attorney, Agent, or Firm*—Robert Ames Norton; Saul Leitner

[57] ABSTRACT

Improved jet-propelled power boat with a tunnel drive and propeller external to the boat to produce the jet and low lines. The boat is fiberglass, and the front is rounded to prevent cracking when docking or otherwise striking an object. The cockpit is surrounded with a raised deck on all sides, including the rear, and also by raised rails on the inner portion of the deck sides. Cellular plastic flotation is used instead of air chambers, which can puncture, and individual air intakes to a closed engine compartment at a level above the highest part of the deck prevent entry of water that may have splashed into the cockpit.

5 Claims, 6 Drawing Figures

JET-PROPELLED POWER BOAT

RELATED APPLICATION

This application is a continuation-in-part of my earlier application Ser. No. 507,073, filed Sept. 18, 1974, and now abandoned.

BACKGROUND OF THE INVENTION

Recently, there has been designed and sold a small jet-propelled speedboat with external jet propulsion. The boat, which is small and useful among other things for water skiing, is sold under the name "BUCCANEER." This boat has a number of advantages presently, principally the jet drive, which prevents propeller damage as the propeller is in a completely enclosed chamber. This not only permits operating in very shallow water but also makes it possible to run straight over ski ramps and also onto grass where there is a suitable entrance ramp or smooth sandy beaches.

In spite of the advantages referred to above which have made it quite successful, the boat has a number of drawbacks. The front is squared off and has fiberglass which can crack under fairly light blows where there is an edge, increasing danger of cracking when docking or otherwise striking an obstacle. Also, the boat, which is quite short, has somewhat marginal stability; and the rear gas tank, which serves also as the lid for the engine compartment, is high enough so that with some short people the view of the skier is slightly obscured.

A much more serious problem is presented by the fact that in order to ventilate the engine compartments it is more or less open into the cockpit and water splashing into the cockpit can run back into the engine compartment, which sometimes creates a problem. Successful as the design has proved to be, it will be apparent that there are certain drawbacks, which in some cases have raised problems of Coast Guard certification of seaworthiness. It is with an improved jet-propelled boat that the present invention deals.

Other prior art is represented by several patents, the first and more important being the Jacobson Patent No. 3,623,447, Nov. 30, 1971. This patent shows a jet-propelled boat with a raised deck on either side of a cockpit which is completely open in the rear, though the cockpit floor is normally above the water line. The deck is not provided with rails on the inner portion of the two side decks, which are raised above the level of the cockpit. The Jacobson patent, however, does show a rounded front, which is one, but only one, of the features of the present invention. When proceeding in calm water in a straight line, water does not enter the cockpit at its open aft end, but if a sharp turn is made, waves from the wash can flow in and cover the cockpit floor. The same is true if the boat is proceeding in choppy water and slows down; in such a case following waves can also inundate the cockpit floor. Theoretically, the cockpit floor is supposed to be watertight, but this is an ideal which is often not fully achieved in practice; and when the cockpit floor is inundated to a substantial depth, hydrostatic pressure can cause water to flow through the floor and into the engine compartment. This raises the hazard of engine stall under extreme conditions.

During the prosecution of the parent application, the Examiner pointed out that boats with raised decks surrounding the cockpit on all sides were not, by themselves, unknown in power boats and for this purpose cited the Del Vecchio Pat. No. 3,718,111, Feb. 27, 1971, which, though dealing with a quite different type of boat, an outboard driven boat, did show raised decks surrounding all sides of the cockpit, in other words, illustrating a feature which, by itself, for other types of boats is not unknown.

SUMMARY OF THE INVENTION

In the present invention, while the basic components of the "BUCCANEER" type boat are retained, the drawbacks have been eliminated without eliminating any of the advantages; for example, the tunnel compartment for jet propulsion, which greatly simplifies the mechanism for producing a jet, is retained. The invention, of course, is a combination invention which does not depend on the individual patentability of any particular element by itself.

The serious problem of cracking of the fiberglass at the bow is solved by having the bow developed into a smoothly curved profile with no sharp corners or edges so that when docking, or an object or obstacle is struck, the fiberglass does not crack. The problem of stability and rear vision is solved by having a longer but somewhat shallower tank lid, which also brings the weight of the fuel somewhat lower, thus increasing stability. This effect is sufficiently great so that the tank may be made much larger because the low profile tank can, of course, extend further to the rear without raising the center of gravity.

As the little boat runs at fairly high speeds, spray is produced if there are any waves at all and can splash into the cockpit. Since the engine compartment has to be ventilated, the oenings to the cockpit permit this water to run back into the engine compartment, with the problems, which in rougher weather can be quite serious, which result from presence of water in and around the engine. One of the improvements of the present invention is to make the engine compartment completely separated from the cockpit, ventilation being provided with two cowl vents which have high intakes and reject most water and are, therefore, not in danger of receiving any significant amount of spray. While the problem of water in the engine compartment rarely causes a serious accident, it can stall the motor or at least require extensive removal of water and drying out, which is inconvenient.

Another important safety feature is the elimination of air flotation tanks as under the somewhat strenuous use to which these small boats are subjected puncturing of such compartments by striking sharp objects either floating or fixed can result in serious loss of buoyancy. In the present invention, there are no air tanks, the flotation being entirely of cellular plastic, foam, cell-tight, etc., such as polyurethanes, polystyrenes and the like; and if the portion of the hull over the flotation compartments is punctured, buoyancy is hardly affected at all. This is an important safety factor which has resulted in difficulties in certain jurisdictions for Coast Guard certification. Even where the loss of buoyancy is not so great with an air tank that an actual accident occurs, and usually and customarily the air tanks are subdivided, still the result is that the boat sinks much lower in the water and the problem of water entering the cockpit and flowing back to the engine compartment is increased. The important increase in safety with solid flotation components is obtained without any significant cost penalty. Since plastic is fairly low priced, it is very durable, and the elimination of the necessity for extreme air chamber compartments usually makes overall flotation cost lower. The advantages which have been set out above are thus obtained without significant increase in cost.

The Jacobson patent, which has been referred to above, represents the closest published prior art. It does show a one-piece, smoothly-curved bow section and shows high air intakes to the engine compartment. However, a raised deck is shown only on two sides of the cockpit, which is wide open at its after end. The problems which can arise, of inundating the cockpit and possible leakage of water through the cockpit floor into the engine compartment, have been described in connection with the description of the Jacobson patent above. They represent definite problems; and the present invention, which has a raised deck on all sides of the cockpit, including its aft end, completely avoids the problem. Incidentally, the Jacobson patent does not show any raised rail around the side edges of the cockpit. There is no suggestion of remedying the problems presented by the open aft end, and in fact there is no mention of the problems at all.

The Del Vecchio patent, referred to above and which relates to an entirely different design of boat, namely one driven by an outboard motor, was cited in the prosecution of the parent case, and does show that as a broad concept applied to different designs of boats a raised deck at the after end of the cockpit is not broadly a new concept. However, there is no suggestion in either of the two patents of combining them; and in fact the Del Vecchio patent has an outboard motor open at the top and which can be soaked by spray. The present invention is a combination of a number of features some of which taken by themselves and outside of the combination are not unknown concepts, and it is the combination of elements, whether known or new, which represents the present invention.

In addition to the basic features of the combination of the present invention, there are some auxiliary features which are desirable: Higher windshields are helpful, particularly in rougher seas, to reduce spray in the cockpit and, even more importantly, protect the steering and instrument and control panel from corrosion; higher sides provide the same function and are also desirable, as is the further increase of leg room of two persons using the boat, and more importantly, legal weight carrying capacity is increased. These features are preferably included although not constituting the principal basic features of the present invention.

Some important additional features of the present invention are represented by the location of air intakes above the highest point on the decks surrounding the cockpit and preferably between inner rails surrounding the sides of the cockpit, which gives additional protection against spray. The air intakes are preferably capped, so that air enters in from the bottom of the cap, and there can be provided mesh which, while readily permitting air to flow through, deflects spray onto the deck. Such caps by themselves are not unknown and constitute, therefore, an additional known feature which is combined with others to make up the combination represented by the present invention.

DESCRIPTION OF THE PREFERRED EMBODIMENTS

Figure 4:
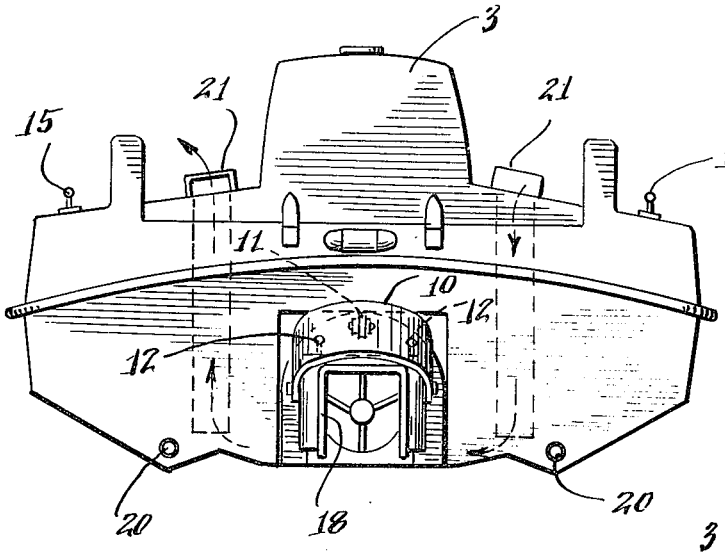
FIG. 4 is a transverse section through the boat and jet taken along the line 4—4 of FIG. 2.

The boat has a fiberglass hull and the bottom has a cathedral structure, as can be seen in FIG. 4.

Figure 1:
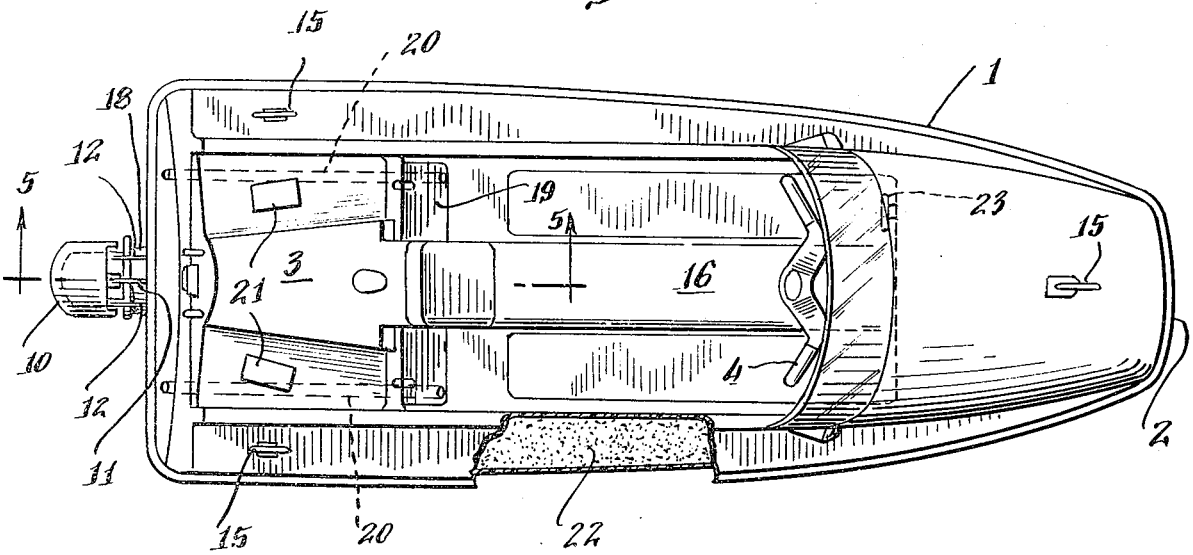
FIG. 1 is a plan view of the boat.
Figure 2:
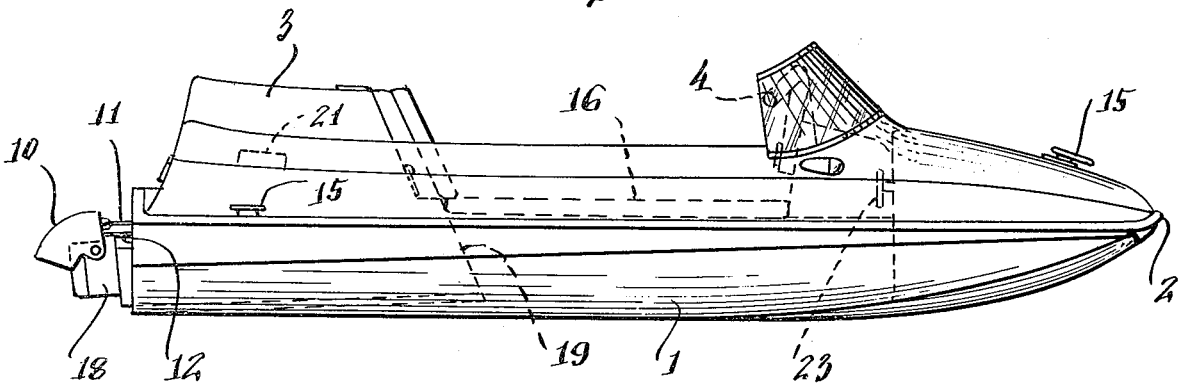
FIG. 2 is a side elevation looking from the starboard side.

The front (2) is curved and has no edge. This is best seen in FIG. 2. The seat (16) for two people in tandem in the middle of the cockpit can be seen in FIG. 1, and the airplane type yoke control (4) is substantially unchanged from the "BUCCANEER" design. Steering control, which is provided with twist grip throttle, and other engine control are best seen in FIG. 1 but appear also in phantom in FIG. 2, and a portion of the seat can be seen in FIG. 5.

Figure 3:
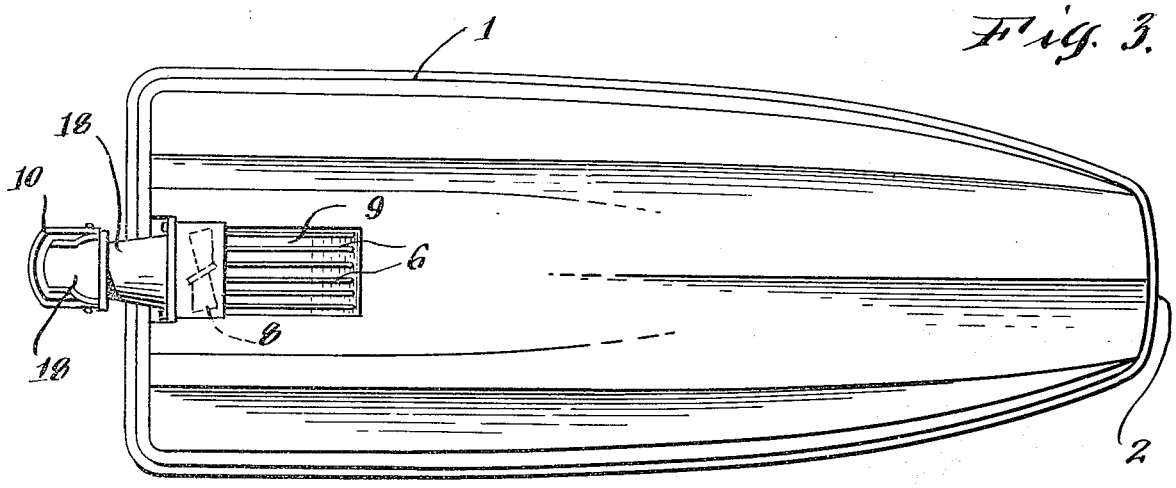
FIG. 3 is a plan view of the bottom of the boat looking up.

Jet production is by a propeller (8) in a tunnel (9) which is completely outside the hull and is provided with an inlet grill (6) to prevent entry of large solids. A propeller (8) is turned on a shaft through a conventional flexible coupling (17) between the inboard motor (7) and the propeller. As this type of motor is a commercially available motor the details of which are not changed by the present invention, it is shown purely diagrammatically in FIG. 5, which is the best showing of the elements described although the grill (6) can be seen somewhat more clearly in FIG. 3.

Figure 5:
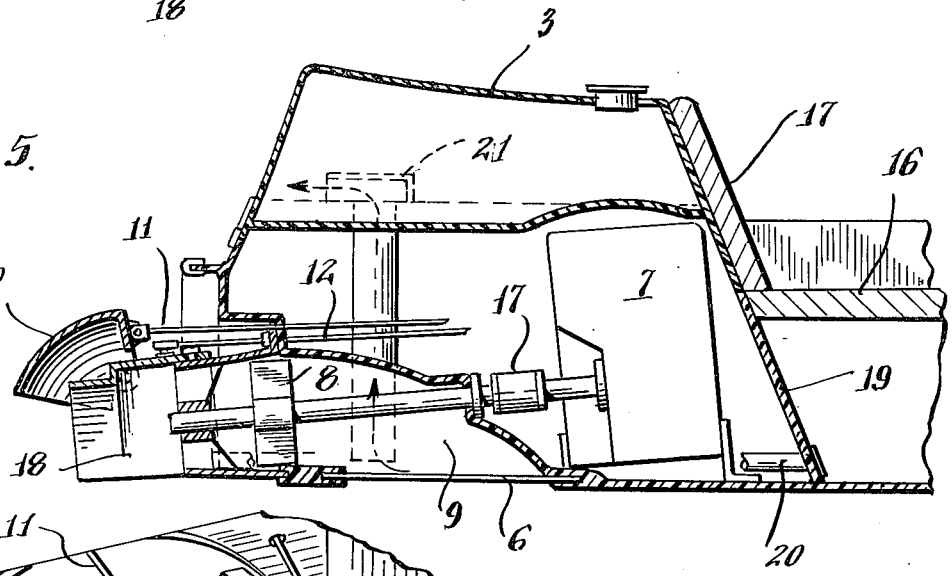
FIG. 5 is a longitudinal section of the rear of the boat.
Figure 6:
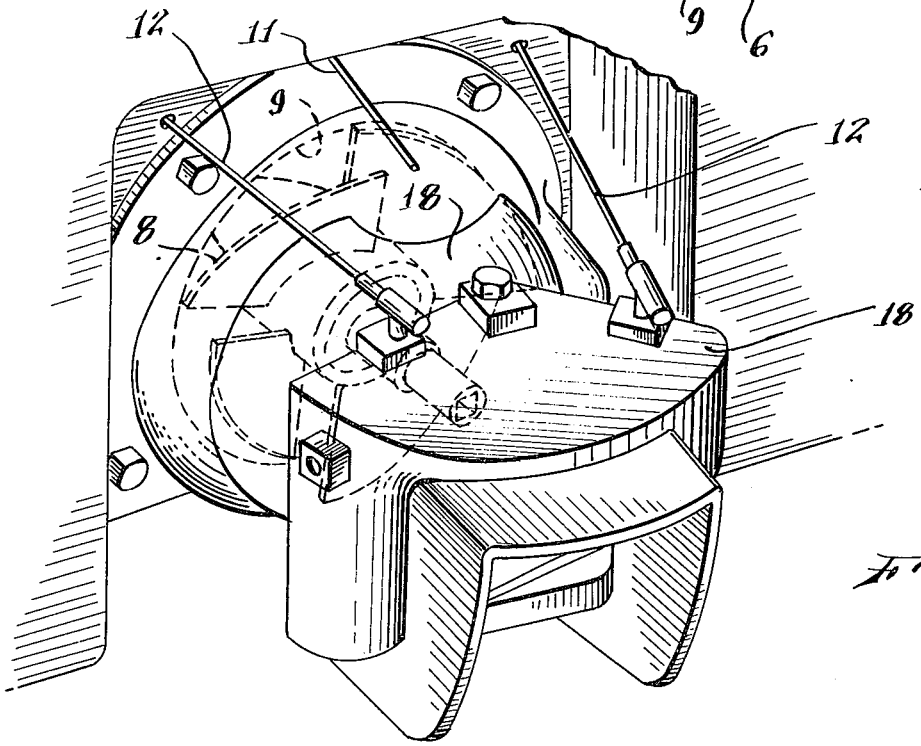
FIG. 6 is an enlarged perspective of the jet mechanism.

The jet of water produced by the propeller extends into the housing (18), (best seen in FIG. 6), which is pivoted and can be turned by two control cables (12) from the yoke (4). As with most jet-propelled boats, steering is effected by turning the direction of the jet. For reverse, the clam shell member (10), which is best seen in FIG. 5, is pivoted and controlled by the rod (11). The operation of this element, as conventional, thrusts the jet forward and serves as a reverse.

The fuel tank (3), as has been described above, is long and low and also serves as a lid for the engine compartment, as can be seen in FIG. 5. However, the engine compartment is completely separated by a watertight bulkhead (19) from the rest of the boat so that if spray accumulates in the cockpit proper it cannot run back into the engine compartment. Ventilation is effected by two cowl ventilators, best seen in FIGS. 4 and 5. These ventilators (21) have their intakes quite high, as can be seen in FIG. 4, and therefore do not present the danger of receiving heavy spray which could flood the engine compartment and at least accumulate, requiring elaborate removal and drying. The ventilators or air intakes are shown of the capped type, the showing being diagrammatic, and this further prevents spray from reaching the engine compartment. As capped ventilators with air coming in from the bottom and making a sharp turn before going down to the engine compartment are elements which by themselves are not unknown in boating, they are therefore illustrated more or less diagrammatically.

As can be seen in the improved boat of the present invention, it retains all of the advantages of the "BUCCANEER" design without its drawbacks. This represents the happy situation where improved constructions or elements do not require any compromise with other desirable elements. Conventional cleats (15) are, of course, provided, as can be seen in FIGS. 1, 2 and 4.

I claim:

1. In a jet propelled, high speed fiberglass boat provided with a cockpit and deck raised above the floor of the cockpit on all sides, fore, aft, and both sides, a jet tunnel completely external to the boat and driven by an inboard engine, the improvements which comprise, in combination, a. a completely rounded bow having a continuous surface, b. a solid bulkhead between engine compartment and the rest of the boat, including the cockpit, preventing flow of any water from the cockpit to the engine compartment, c. flotation in the form of cellular plastic, d. rails along the edges of the cockpit raised above the deck, and e. separate and independent ventilating means for the engine compartment having air intakes and exhaust at least as high as any part of the deck and located inboard of the rails.

2. A boat according to claim 1 in which the gas tank, which forms a lid for the central portion of the engine compartment, is long and low, whereby the weight of fuel is kept lower in the boat.

3. A boat according to claim 1 in which the jet tunnel is provided with a propeller driven by the inboard engine, which propeller produces the jet.

4. A boat according to claim 1 in which the ventilating means are capped, whereby air enters at the bottom of the cap and is turned to flow down through the intake.

5. A boat according to claim 3 in which the ventilating means are capped, whereby air enters at the bottom of the cap and is turned to flow down through the intake.

* * * * *